US009154863B2

(12) United States Patent
Smith

(10) Patent No.: US 9,154,863 B2
(45) Date of Patent: Oct. 6, 2015

(54) SPEAKER ENCLOSURE AND METHOD FOR ELIMINATING STANDING WAVES THEREIN

(71) Applicant: John Smith, Copiague, NY (US)

(72) Inventor: John Smith, Copiague, NY (US)

( * ) Notice: Subject to any disclaimer, the term of this patent is extended or adjusted under 35 U.S.C. 154(b) by 0 days.

(21) Appl. No.: 14/139,030

(22) Filed: Dec. 23, 2013

(65) Prior Publication Data

US 2014/0174847 A1 Jun. 26, 2014

Related U.S. Application Data

(60) Provisional application No. 61/745,889, filed on Dec. 26, 2012.

(51) Int. Cl.
*H04R 1/02* (2006.01)
*H04R 1/28* (2006.01)

(52) U.S. Cl.
CPC ..... *H04R 1/02* (2013.01); *H04R 1/2884* (2013.01); *H04R 1/026* (2013.01); *H04R 1/2846* (2013.01)

(58) Field of Classification Search
CPC ..... H04R 1/26; H04R 1/345; H04R 1/2869; H04R 1/2873; H04R 1/2884; H04R 1/2888
USPC ..... 181/155, 156, 189, 199; 381/160, 352
See application file for complete search history.

(56) References Cited

U.S. PATENT DOCUMENTS

| | | | | | |
|---|---|---|---|---|---|
| 2,792,069 | A * | 5/1957 | Gately, Jr. | ..... | 181/145 |
| 4,167,985 | A * | 9/1979 | Dunlavy | ..... | 181/148 |
| 4,215,761 | A * | 8/1980 | Andrews | ..... | 181/152 |
| 4,413,703 | A * | 11/1983 | Kato et al. | ..... | 181/156 |
| 4,750,585 | A | 6/1988 | Collings | | |
| 5,056,616 | A | 10/1991 | Astrom | | |
| 5,099,948 | A * | 3/1992 | Melhart | ..... | 181/152 |
| 5,446,792 | A * | 8/1995 | Sango | ..... | 381/160 |
| 5,639,996 | A | 6/1997 | Tan | | |
| 5,996,728 | A * | 12/1999 | Stark | ..... | 181/144 |
| 6,056,083 | A | 5/2000 | Daniell | | |
| 6,152,257 | A * | 11/2000 | Denham | ..... | 181/155 |
| 6,324,292 | B1 | 11/2001 | Mitsuhashi et al. | | |
| 6,411,721 | B1 * | 6/2002 | Spindler | ..... | 381/349 |
| 6,625,291 | B1 * | 9/2003 | Mohler | ..... | 381/337 |
| RE39,330 | E | 10/2006 | Tozawa | | |
| 7,604,091 | B2 | 10/2009 | Kane et al. | | |
| 8,104,569 | B2 | 1/2012 | Klein | | |
| 2005/0087392 | A1 | 4/2005 | Flanders et al. | | |
| 2012/0300967 | A1 | 11/2012 | Saiki | | |
| 2013/0105244 | A1 * | 5/2013 | Moreton Cesteros | ..... | 181/199 |

FOREIGN PATENT DOCUMENTS

| | | |
|---|---|---|
| DE | 3248340 | 12/1982 |

* cited by examiner

*Primary Examiner* — Jeremy Luks
(74) *Attorney, Agent, or Firm* — Epstein Drangel LLP; Robert L. Epstein

(57) ABSTRACT

A speaker enclosure and method of building same is provided for redirecting standing waves outside the enclosure. The enclosure includes an exterior and an interior comprised of a body having six interior surfaces defining the interior. One of the surfaces has a speaker opening and another of the surfaces has a tuned port opening and defines four corners opposite the speaker opening. An element having an acoustically reflective surface faces the interior and is positioned in a plane that intersects and is inclined with respect to each of the interior surfaces that form the corner. A handle system that includes an attachment means is mounted to the exterior of the enclosure. A rotatable and detachable handle is mounted to the attachment means.

23 Claims, 8 Drawing Sheets

SPEAKER ENCLOSURE AND METHOD FOR ELIMINATING STANDING WAVES THEREIN

CROSS-REFERENCE TO RELATED APPLICATION

This application claims the benefit of provisional patent application Ser. No. 61/745,889 filed in the United States Patent and Trademark Office on Dec. 26, 2012 and is incorporated in its herein by reference.

BACKGROUND OF THE INVENTION

1. Field of the Invention

This invention relates generally to loudspeakers for use in audio systems, and more particularly, to a speaker enclosure and method of building same for overcoming standing wave phenomena by eliminating the generation of standing waves within the enclosure.

2. Description of the Related Art

Eliminating low frequency sound waves generated inside speaker enclosures is an important focus of research and discovery for improving sound quality generated by speaker systems. Drivers positioned within speaker enclosures generate low frequency sound waves into the enclosure which reflect multiple times to create resonances. Resonances are peaks and dips in sound pressure levels that lack coherency and direction, causing sound to be altered. These resonances are often called standing waves and are the result of modes of vibration associated with resonance in extended objects like strings and air columns having characteristic patterns.

Standing waves have a negative impact on low and low-mid frequency integrities and a variety of commonly known measures are available to lessen the standing waves negative effects. Conventional approaches attempt to eliminate standing waves by stuffing the speaker enclosure, for example a bass chamber, with absorption and/or dampening materials. The materials may include fiberglass insulation, foam rubber, cloth, felt or spun wool. The energy created by the standing waves is then dissipated into in dampening material.

It is, therefore, a primary object of the present invention to provide a speaker assembly having an enclosure for mounting a low-range speaker driver therein and method for eliminating the standing waves generated by the driver by redirecting the waves to exit the enclosure.

It is another object of the present invention to provide a speaker enclosure having an interior defining at least four interior corners wherein at least one corner contains an element mounted thereto having an acoustically reflective surface.

It is another object of the present invention to provide the acoustically reflective surface within the interior of the enclosure in a plane that intersects and is inclined with respect to each of the interior surfaces that form the corner for redirecting the standing waves and utilizing the energy they create, rather than conventional approaches which attempt to absorb the energy.

It is another object of the present invention to provide a tuned port within the body of the speaker enclosure for allowing standing waves redirected from the acoustically reflective surface to exit therethrough.

It is another object of the present invention to provide a speaker assembly that combines multiple drivers within an enclosure (for example, subwoofers, woofers, mid-high range drivers, and tweeters) for providing low-range, mid-range and/or high-range speaker sound.

It is another object of the present invention to provide a multiple driver speaker assembly having more than one time-aligned chamber body, including a high-range frequency chamber adjacent a low-range frequency chamber within a speaker enclosure, wherein each chamber body has a front wall positioned in different plane.

It is another object of the present invention to provide a multiple driver speaker assembly wherein the front wall of the high frequency chamber is recessed within the enclosure as compared to the front wall of the low frequency chamber in order to create a horn lens effect to enhance the dispersion and throw over distance of the sound created.

It is another object of the present invention to provide a speaker enclosure capable of providing more power and increased efficiency for delivering a more natural sound without the need for including dampening materials therein.

It is another object of the present invention to provide a speaker enclosure capable of increasing the efficiency of the amplification of sound which allows for a greater volume of sound to be created with lesser electric power required.

It is another object of the present invention to provide a speaker enclosure which improves the value of sonic levels (decibels) and sonic accuracy (frequency response).

It is another object of the present invention to provide a higher level of acoustical integrity within a speaker enclosure, thereby eliminating the need for resistors within complex crossover networks.

It is another object of the present invention to provide a detachable handle system mounted to the exterior of the body of the enclosure which does not invade the interior or diminish the acoustical integrity of the enclosure.

It is another object of the present invention to provide a handle that rotates 360 degrees and locks in a vertical position adjacent the exterior of the enclosure for enabling a user to lift the enclosure without altering the vertical orientation of the enclosure.

It is another object of the present invention to provide a handle capable of locking in a plurality of positions when the enclosure is orientated horizontally for serving as an articulating leg supporting the enclosure.

BRIEF SUMMARY OF THE INVENTION

In accordance with one aspect of the present invention, a speaker enclosure is provided having interior corners, comprising an element shaped like a tetrahedron mounted to one of the interior corners.

In accordance with an additional embodiment, a speaker enclosure is provided having three interior surfaces defining a corner, comprising an acoustically reflective surface positioned in a plane that intersects and is inclined with respect to each of the interior surfaces that form the corner.

In accordance with an additional embodiment, a speaker enclosure is provided having an interior. The enclosure includes a body having six interior surfaces defining the interior of the enclosure. One of the surfaces has a speaker opening and the other of the surfaces defines four corners opposite the speaker opening. The enclosure includes an element having an acoustically reflective surface facing the interior and positioned in a plane that intersects and is inclined with respect to each of the interior surfaces that form the corner.

The speaker enclosure may further include a tuned port opening within the surface opposite the speaker opening. The element of the speaker enclosure may be a tetrahedron. The speaker enclosure may be a bass chamber or mid-high range chamber.

The speaker enclosure may include at least two corners include the element having an acoustically reflective surface positioned facing the interior and being in a plane that intersects and is inclined with respect to each of the interior surfaces that form the corner.

The speaker enclosure may include an exterior having a recessed cavity within and an attachment means mounted within the cavity. The speaker enclosure includes a detachable handle removably mounted to the attachment means. The detachable handle may be rotatable 360 degrees. The detachable handle may adjust and lock in a vertical position. The detachable handle may include an articulating leg when the enclosure is positioned in a horizontal orientation. The articulating leg may adjust to at least three positions.

The body of the speaker enclosure may include a high frequency chamber and a low frequency chamber. The high frequency chamber may be recessed within the body in a substantially different plane from the low frequency chamber.

In accordance with an additional embodiment, a multiple driver speaker enclosure is provided having an interior. The multiple driver speaker enclosure includes a first body having six interior surfaces defining the interior of the body. One of the surfaces has a speaker opening and the other of the surfaces defines four corners opposite the speaker opening. The multiple driver speaker enclosure includes an element having an acoustically reflective surface facing the interior and positioned in a plane that intersects and is inclined with respect to each of the interior surfaces that form the corner.

The multiple driver speaker enclosure may further include a tuned port opening within the surface opposite the speaker opening.

The first body of the multiple driver speaker enclosure may be a bass chamber.

The multiple driver speaker enclosure may further include a second body positioned above the first body and being a mid-high range chamber. The mid-high range chamber includes six interior surfaces defining the interior of the mid-high range chamber, wherein one of the surfaces has a speaker opening and the other of the surfaces defines four corners opposite the speaker opening. The multiple driver speaker enclosure may further include an element having an acoustically reflective surface facing the interior of the mid-high range chamber and being positioned in a plane that intersects and is inclined with respect to each of the interior surfaces that form the corner.

The multiple driver speaker enclosure may include a tweeter positioned within the mid-high range chamber.

In accordance with an additional embodiment, a method of eliminating standing waves in an audio speaker is provided. The steps include providing a speaker enclosure body having an interior comprising interior surfaces, wherein one of the surfaces has a speaker opening and the other of the surfaces defines four corners opposite the speaker opening. The next step includes selectively positioning an element having an acoustically reflective surface within the interior in a plane that intersects and is inclined with respect to each of the interior surfaces that form the corner. The steps may further include positioning a tuned port opening within the surface opposite the speaker opening.

BRIEF DESCRIPTION OF THE SEVERAL VIEWS OF THE DRAWINGS

To these and to such other objects that may hereinafter appear, the present invention relates to a speaker assembly and method of building same for eliminating the generation of standing waves within the assembly as described in detail in the following specification and recited in the annexed claims, taken together with the accompanying drawings, in which like numerals refer to like parts in which:

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

DETAILED DESCRIPTION OF THE INVENTION

Figure 1:
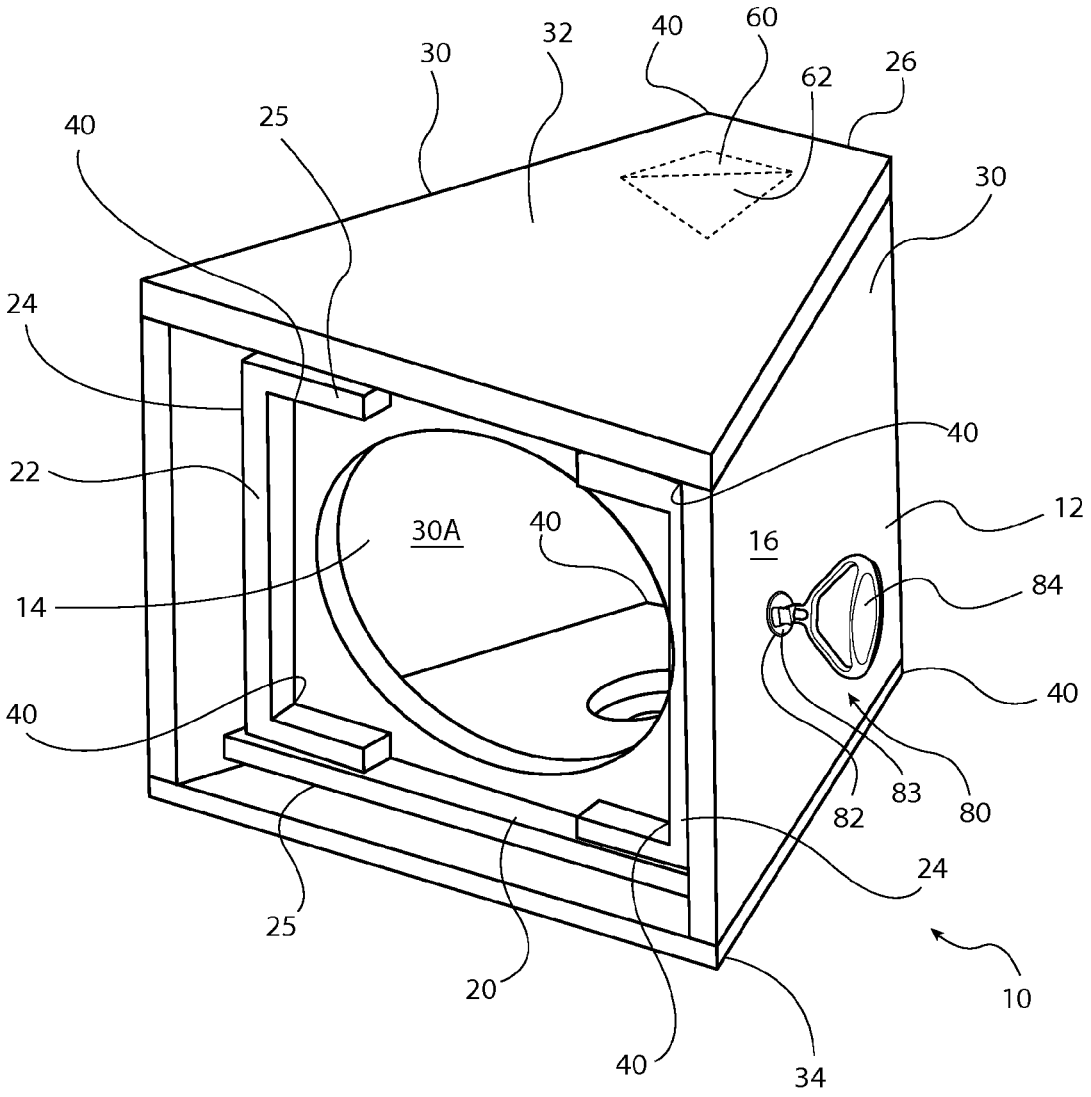
FIG. 1 is a perspective view of a basic single driver speaker assembly of the present invention, having an enclosure comprising six interior surfaces defining the interior of the enclosure, and having an element having an acoustically reflective surface mounted within the interior.
Figure 2:
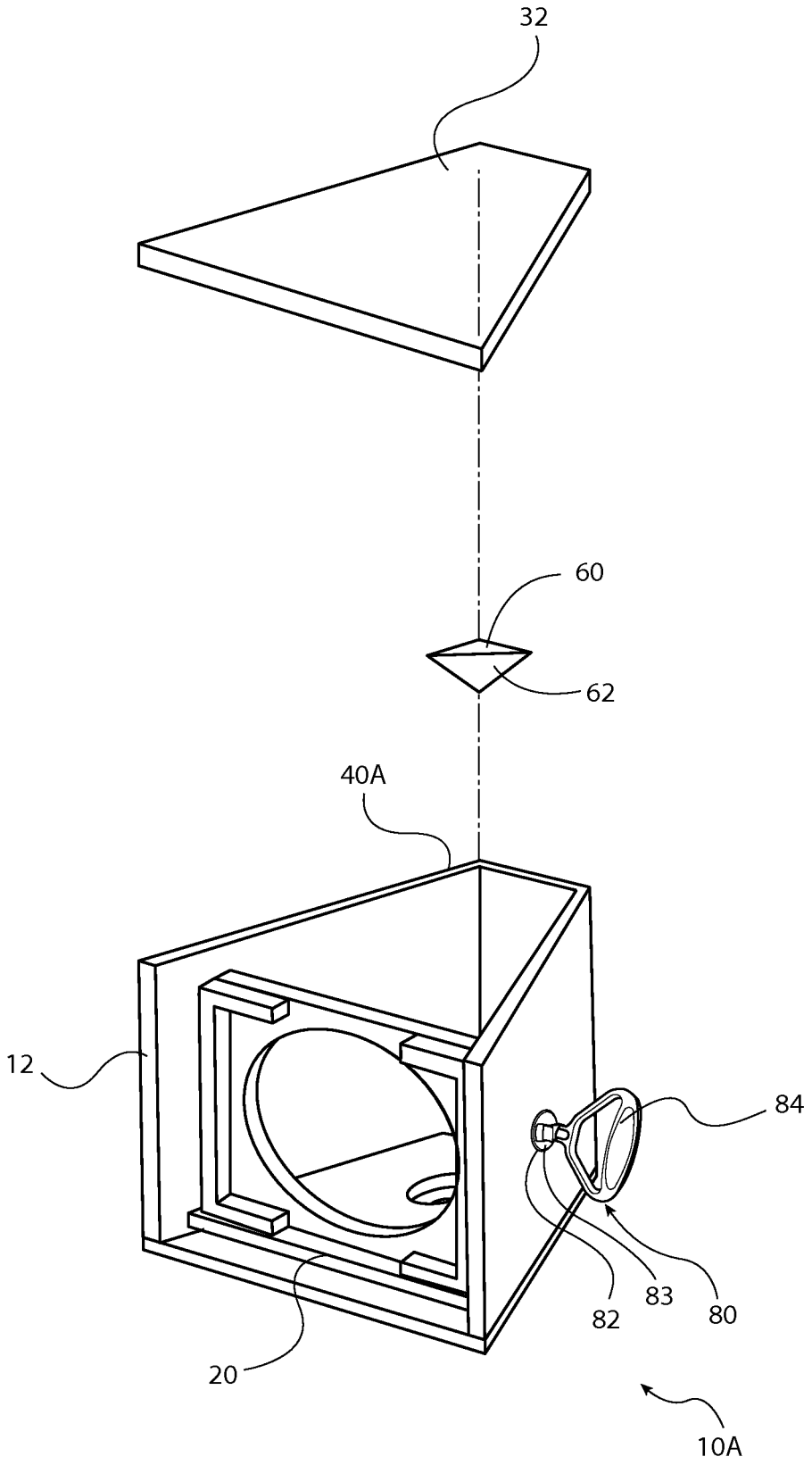
FIG. 2 is an exploded perspective view of the single driver speaker assembly of FIG. 1, showing the details of the element and the acoustically reflective surface mounted to face the interior of the enclosure and positioned in a plane that intersects and is inclined with respect to each of the interior surfaces that form a corner.

The present invention is directed to a speaker assembly 10 and method of implementing same for eliminating the generation of standing waves within the assembly, preventing the distortion of the original sound of the speaker, and improving the articulation of the original sound. FIGS. 1 and 2 illustrate a basic single driver speaker assembly 10A that includes an enclosure 12 having an interior 14 and an exterior 16. The enclosure 12 includes a chamber or cabinet body 20 having a front wall 22 having a first and second pair of opposite edges 24 and 25 respectively, and a back wall 26 spaced-apart the front wall 22. Preferably in the basic assembly 10 the cabinet body 20 is a bass or low-frequency chamber. The front wall 22 includes at least one opening 28 for physically mounting a driver 50 therein. The driver 50 may include, but is not limited to, one of the following, a subwoofer, woofer, mid-high range driver, tweeter or coaxial driver.

The cabinet body 20 further includes opposed side walls 30 that are obliquely tapered from opposite edges 24 of the front wall 22 to the back wall 26. The cabinet body 20 further includes opposed top and bottom walls 32 and 34 respectively, which extend parallel from another pair of opposite edges 25 of the front wall 22 to the hack wall 26.

Figure 3:
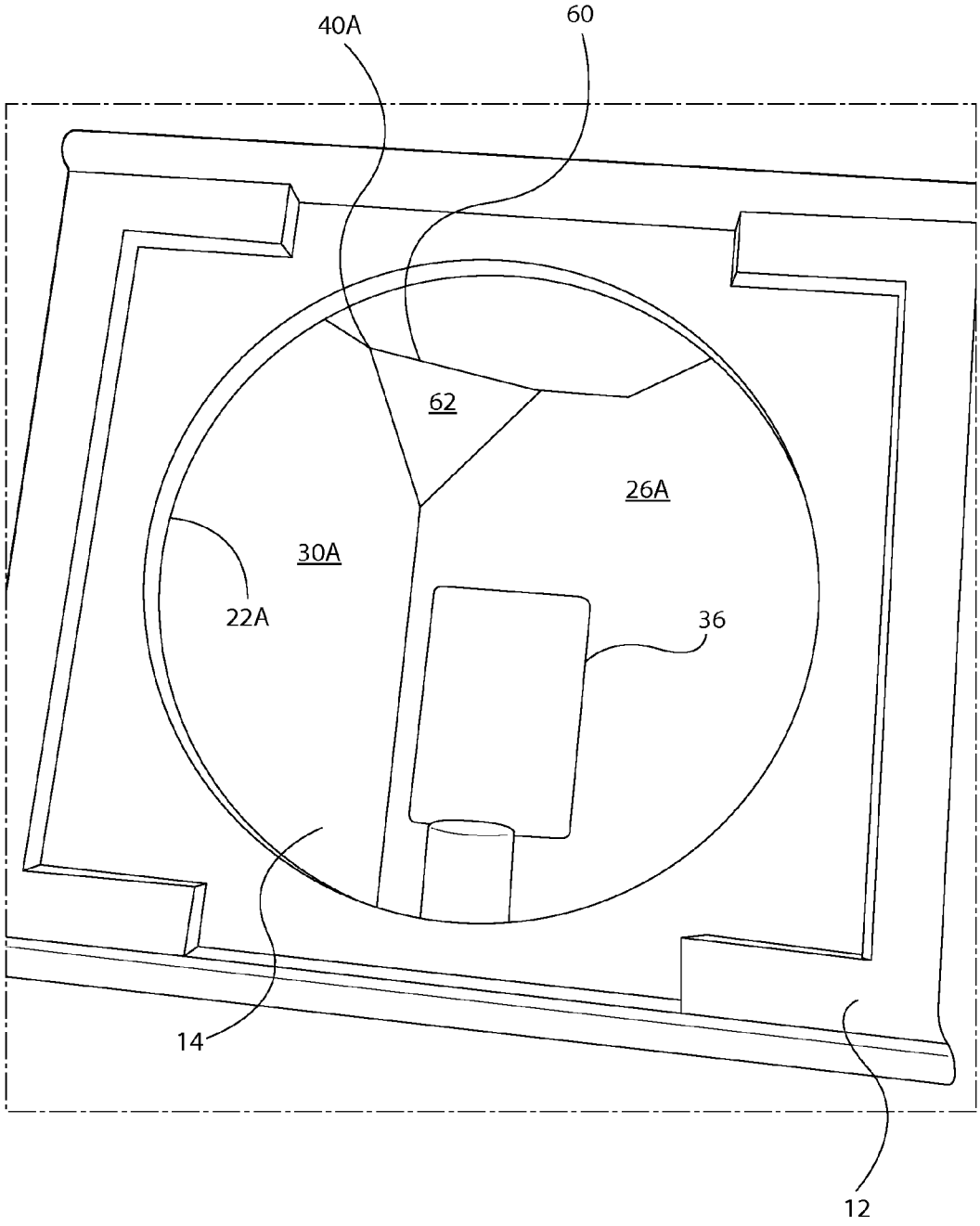
FIG. 3 is a perspective view of a part of the interior of the speaker assembly of FIG. 1 of the present invention.

FIG. 3 illustrates an interior view of the enclosure 12. The back wall 26 includes at least one opening extending therethrough, which is commonly referred to as a vent or port 36 that allows air to flow out of the enclosure 12. The size or length of the port opening 36 is carefully calculated depending on a variety of factors including but not limited to, shape, type and quantity of ports within the enclosure in order to properly provide a tuned port that creates a particular pitch of sound caused by the air blowing out of the port. When calculated correctly the tuned port 36 will aid in redirecting air flow to create natural sound.

Each of the six walls of the cabinet body including the front and back walls, opposed side walls, and top and bottoms walls include exterior surfaces. The cabinet body 20 of the enclosure includes six interior surfaces 22A, 26A, 30A, 32A, 34A, which define the interior 14 of the enclosure 12. The interior surfaces 22A, 26A, 30A, 32A, 34A may correspond to the walls 22, 26, 30, 32, 34 of the enclosure respectively, or alternatively, be separate interior walls which define the body 20 within the interior of the enclosure.

The interior surfaces of the body 20 define eight corners 40, four of which are opposite the front wall 22 and another four opposite the back wall 24. At least one of the corners includes an element 60, which is the focus of the present invention.

In its broadest form, the element 60 is an acoustically reflective surface 62 that faces the interior 14 of the enclosure 12. The surface 62 is uniquely positioned and mounted within the enclosure 12 in a plane that intersects and is inclined with respect to each of the three interior surfaces that form the corner. In particular, the surface 62 is mounted within the top rear corner 40A opposite the front wall 22 containing the driver 50 and faces the interior of the enclosure. The surface 62 intersects with the interior surfaces of one of the side walls 30A and the top and back walls 32A and 26A respectively.

Figure 8:
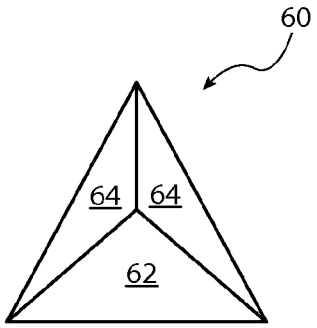
FIG. 8 is a perspective view of the element having the acoustically reflective surface of the present invention.
Figure 9:
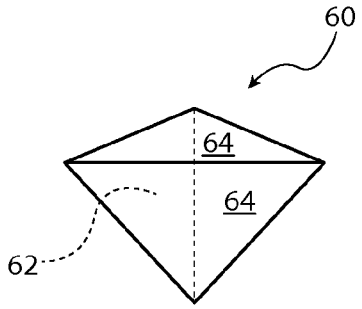
FIG. 9 is another perspective view of the element having the acoustically reflective surface of the present invention.
Figure 10:
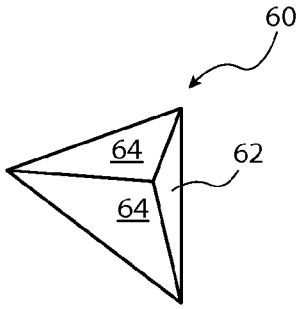
FIG. 10 is yet another perspective view of the element having the acoustically reflective surface of the present invention.

FIGS. 8-10 illustrate the element 60 having the acoustically reflective surface 62, which is preferably a regular tetrahedron. The regular tetrahedron is a polyhedron composed of four triangular faces 64, three of which meet at each corner or vertex, wherein all four of the faces are equilateral triangles and one of the faces is the acoustically reflective surface 62. The element 60 may be hollow or solid. In alternate embodiments, the element may simply be the acoustically reflective surface 62 in the form of an equilateral triangle.

In alternate embodiments, more than one corner may include the element 60 having the acoustically reflective surface 62.

Figure 4:
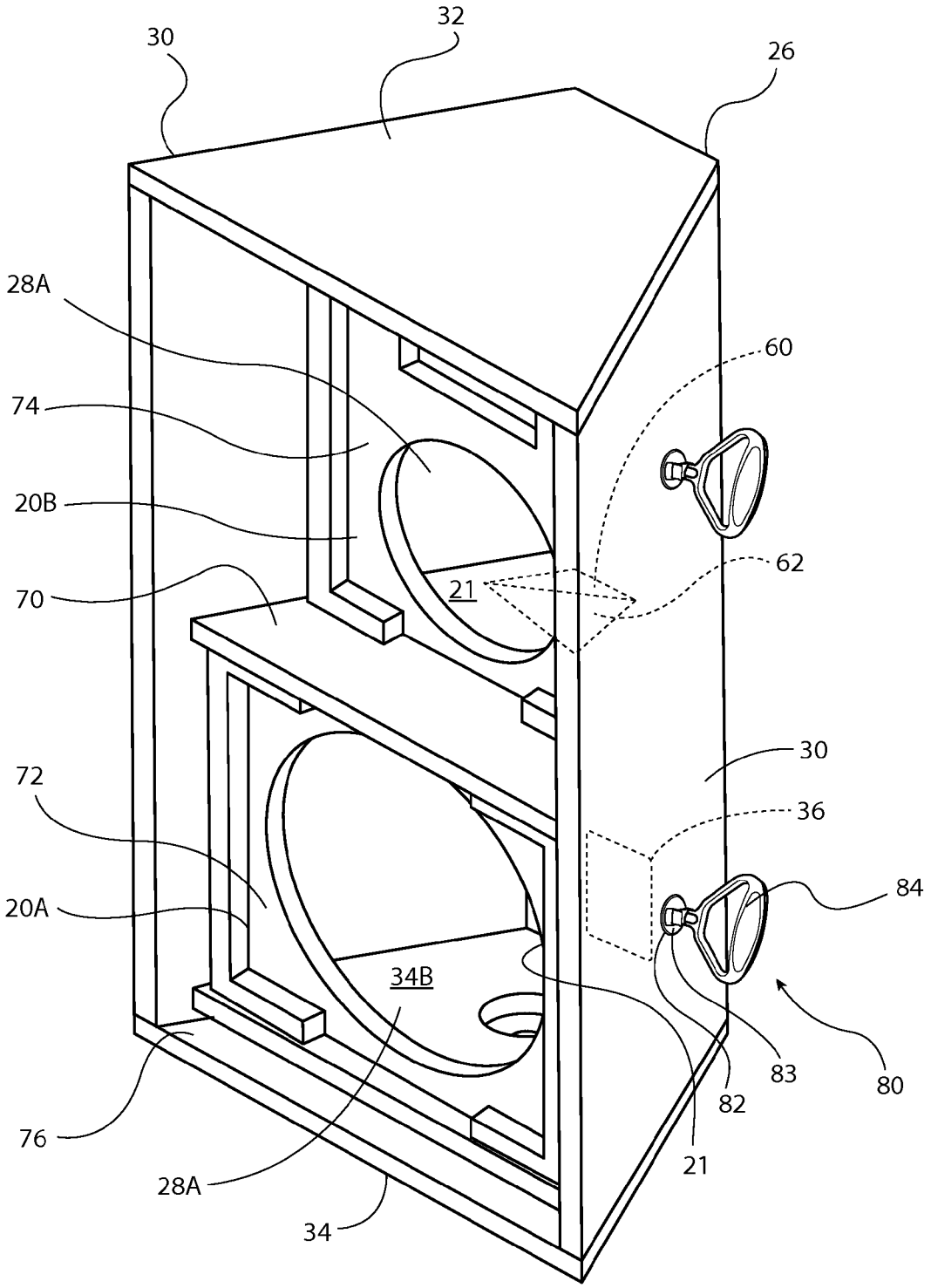
FIG. 4 is perspective view of a multiple driver speaker assembly of an alternate embodiment of the present invention wherein the enclosure contains more than one chamber body, and in particular, a mid-high range chamber body adjacent a bass chamber body, wherein said bass chamber body has an element having an acoustically reflective surface mounted therein.
Figure 5:
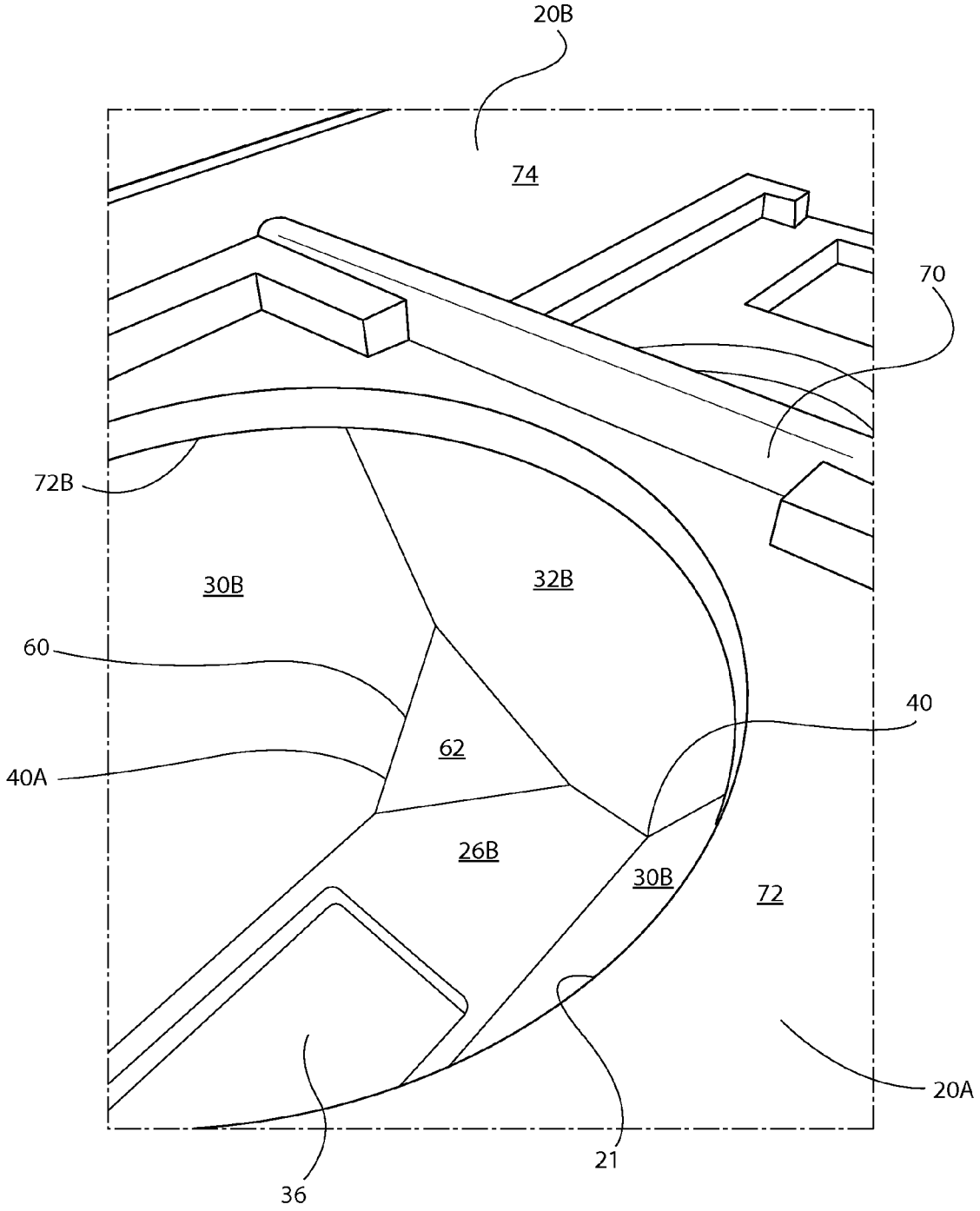
FIG. 5 is a partial perspective view of the interior of the bass chamber body of FIG. 4 of the present invention.

FIGS. 4 and 5 illustrate an additional embodiment of the present invention wherein a multiple driver speaker assembly 10B is provided. The assembly includes the enclosure 12 having more than one chamber or cabinet body 20 recessed therein. In particular, the enclosure includes a first or low-range/bass chamber body 20A adjacent a second or mid-high range chamber body 20B. A partition wall 70 separates the first and second chamber bodies 20A and 20B and extends parallel to the top and bottom walls 32, 34 of the enclosure 12 to define an interior 21 of first and second chamber bodies 20A, 20B respectively.

The enclosure 12 of the multiple driver speaker assembly 10B includes a front 76 that preferably comprises two separate wall portions including a first front wall 72 for enclosing the first chamber body 20A and a second front wall 74 for enclosing the second chamber body 20B. Both the first and second front walls 72, 74 include at least one opening 28A and 28B respectively, for physically mounting a driver 50 therein. Preferably, the driver 50 mounted within the first front wall 72 is a low-range driver and the driver 50 mounted within the second front wall 74 is a mid-high range driver. The mid-high range driver may include a tweeter positioned therein.

The first and second front walls 72, 74 are not within a similar plane. In particular the second wall 74, which encloses the high-frequency chamber, is recessed further into the interior of the enclosure than the first wall 72. The recessed position of the second wall 74 allows the high-range driver mounted therein to be further away from the ears of a listener as compared to the low-range driver mounted within the opening of the first front wall 72.

Each bass chamber body 20A has six interior surfaces which define the interior 21. The interior surfaces 72B, 26B, 30B, 32B, 34B of the first chamber body 20A may correspond to the walls 72, 26, 30, 32, 34 of the enclosure respectively, or alternatively, be separate interior walls which define the body 20A within the interior 14 of the enclosure. The interior surfaces 72B, 26B, 30B, 32B, 34B define eight corners 40, four of which are opposite the first front wall 72 and another four opposite the back wall 26. At least one of the corners includes the tetrahedron element 60 having the acoustically reflective surface 62 that faces the interior 21 of the first body 20A. The surface 62 is similarly positioned and mounted within the interior 21 of the first chamber 20A of the enclosure 12 in a plane that intersects and is inclined with respect to each of the three interior surfaces that form the corner. In particular, the surface 62 is mounted within the top rear corner 40A opposite the front wall 72 containing the low-range driver 50. The surface 62 intersects with the interior surfaces of one of the side walls 30B and the top and back walls 32B and 26B respectively.

Figure 6:
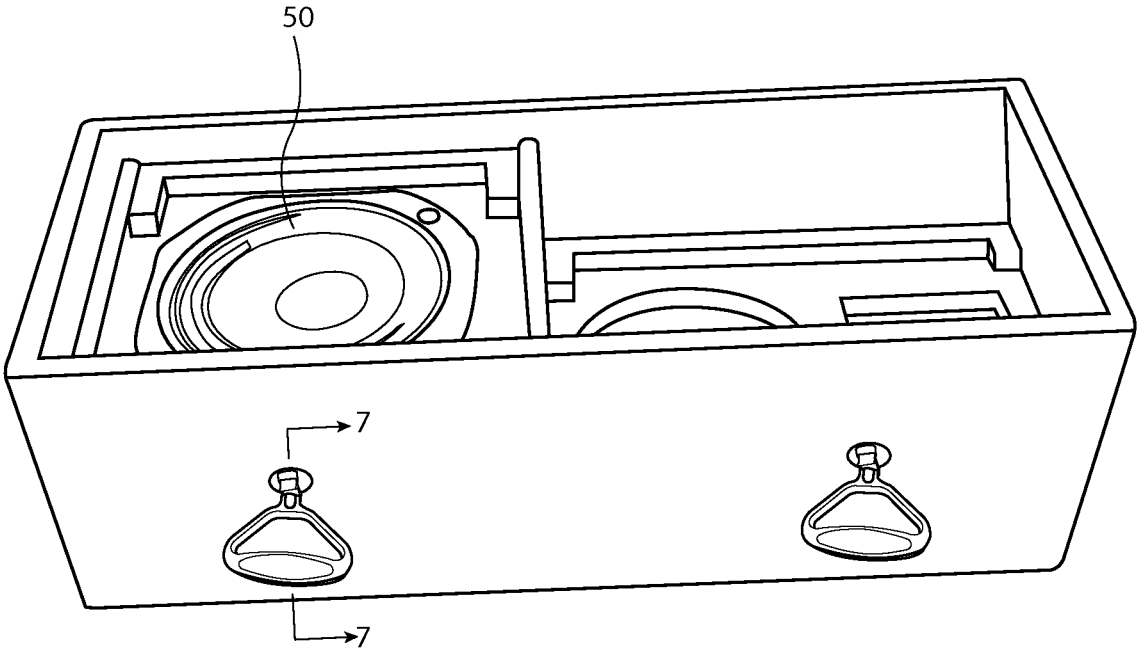
FIG. 6 is a perspective view of the multiple driver speaker assembly of FIG. 4 having a pair of detachable handles mounted to a side thereof.
Figure 13:
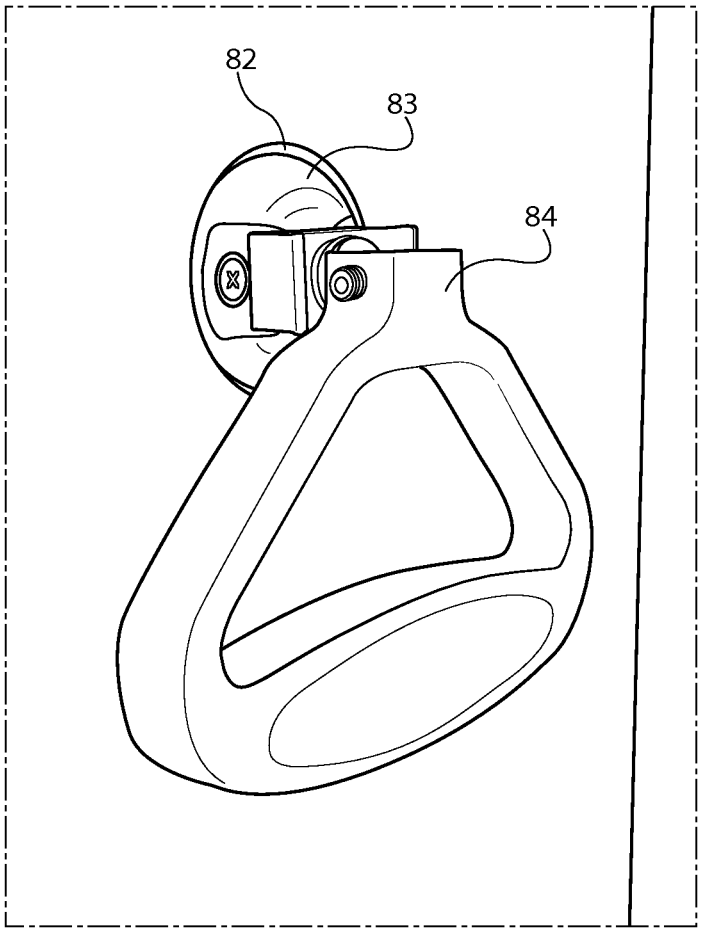
FIG. 13 is a perspective view of the handle system showing the attachment means mounted to the side of the enclosure and the detachable handle mounted thereto.

FIGS. 6 and 13 illustrates the handle system 80 of the present invention, having an attachment means 83 which is substantially flush mounted with the exterior 16 of the enclosure 12 and does not invade the interior 14 of the enclosure or interior 21 of the body 20, so as to not diminish the acoustical integrity of the enclosure 12.

Figure 7:
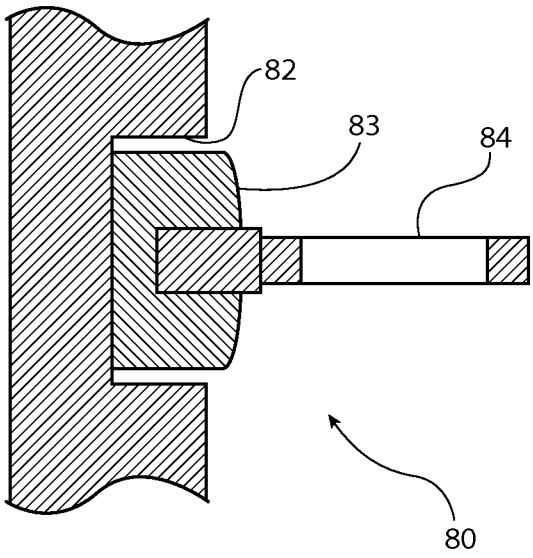
FIG. 7 is a cross-sectional view of the handle system of the present invention taken along line 7-7 of FIG. 6.
Figure 12:
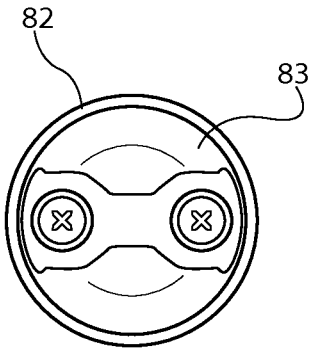
FIG. 12 is a front plan view of an attachment means of the handle system for mounting a detachable handle thereto.

FIG. 7 illustrates a cross-sectional view of the handle system 80, which includes a recessed cavity 82 extending within the exterior 16 of one or more side walls 30 of the enclosure 12. The attachment means 83 is preferably a circular button like object mounted within the recessed cavity 82 and is secured in position by a pair of screws, bolts or other like fasteners as shown in FIG. 12. A detachable handle 84 is securely mounted to the attachment means 83 shown in FIG. 13. The recessed cavity 82 and detachable handle 84 extend within at least one wall of the enclosure but remain outside the interior 21 of the cabinet body 20.

As FIG. 12 illustrates, the attachment means 83 includes two substantially curved tabs for connecting with the detachable handle 84. The detachable handle is able to rotate 360 degrees and locks in a vertical position for aiding a user in lifting the enclosure. The handle 84 is also able to lock in a position adjacent the recessed cavity 82. In addition, the handle 84 is able to adjust and lock in a variety of different and useful positions.

In FIG. 6 when the multiple driver speaker embodiment is shown, a pair of detachable handles 84 is illustrated mounted to at least one side of the enclosure. In alternate embodiments, one or more detachable handles 84 may be mounted to the front wall 22, back wall 26, side walls 30, top wall 32 or bottom wall 34.

Figure 11:
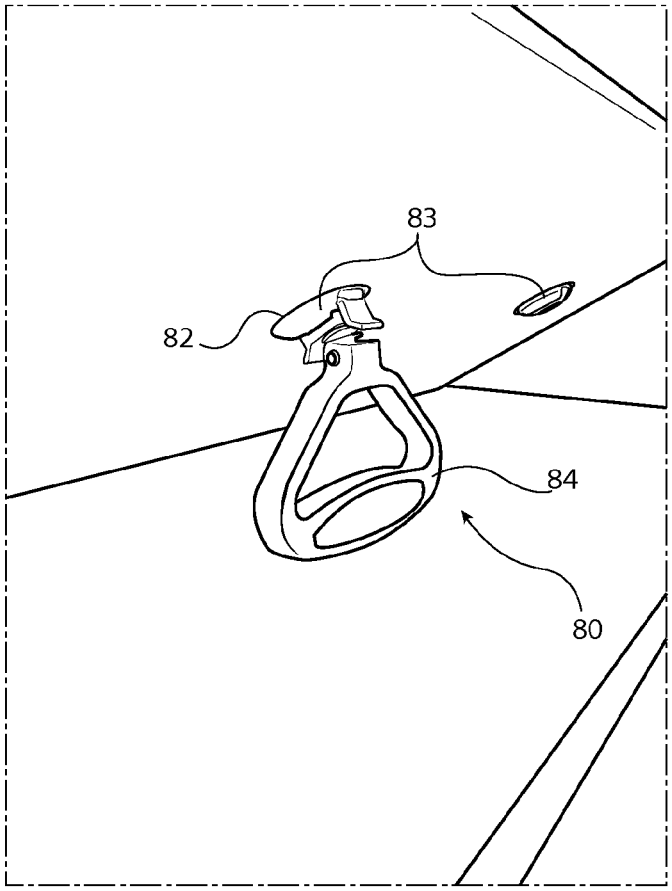
FIG. 11 is a perspective view of the handle system of the present invention showing the detachable handle in use as an articulating leg supporting the multiple driver speaker assembly of FIG. 4 when in a horizontal position.

In FIG. 11, the enclosure is in an inclined horizontal position wherein the handle 84 is locked in a vertical position and serves as an articulating leg supporting the enclosure.

In conclusion, herein is presented a speaker assembly and method of implementing same for eliminating the generation of standing waves within the assembly. The invention is illustrated by example in the drawing figures, and throughout the written description.

It should be understood that numerous variations are possible, while adhering to the inventive concept. Such variations are contemplated as being a part of the present invention.

While only a limited number of preferred embodiments of the present invention have been disclosed for purposes of illustration, it is obvious that many modifications and variations could be made thereto.

The present application is intended to cover all of those modifications and variations, which fall within the scope of the present invention as defined by the following claims.

I claim:

1. An enclosure for a speaker having an interior, comprising:

a body having six walls with interior surfaces defining said interior of said enclosure, wherein one of said walls comprises a front wall having a speaker opening adapted to receive the speaker and the other of said surfaces defining four corners opposite said speaker opening; and an element mounted entirely within one of said corners, facing said front wall, said element having an acoustically reflective surface facing said interior positioned in a plane that intersects and is inclined with respect to each of said interior surfaces of said walls that form said one corner.

2. The speaker enclosure of claim 1 further comprising a tuned port opening within said surface opposite said speaker opening.

3. The speaker enclosure of claim 1 wherein said element is a tetrahedron.

4. The speaker enclosure of claim 1 wherein the speaker enclosure is a bass chamber.

5. The speaker enclosure of claim 1 wherein the speaker enclosure is a mid-high range chamber.

6. The speaker enclosure of claim 1 wherein at least two corners include said element having an acoustically reflective surface positioned facing said interior and being in a plane that intersects and is inclined with respect to each of said interior surfaces that form said corner.

7. The speaker enclosure of claim 1 wherein said enclosure includes an exterior having a recessed cavity within said exterior and further comprising an attachment means mounted within said cavity of said exterior.

8. The speaker enclosure of claim 7 further comprising a detachable handle removably coupled to the attachment means.

9. The speaker enclosure of claim 8 wherein the detachable handle is rotatable 360 degrees.

10. The speaker enclosure of claim 8 wherein the detachable handle adjusts and locks in a vertical position.

11. The speaker enclosure of claim 8 wherein the detachable handle is an articulating leg when said enclosure is positioned in a horizontal orientation.

12. The speaker enclosure of claim 11 wherein said articulating leg adjusts to at least three positions.

13. The speaker enclosure of claim 1 wherein said body further comprises a high frequency chamber and a low frequency chamber.

14. The speaker enclosure of claim 13 wherein said high frequency chamber is recessed within said body in a substantially different plane from said low frequency chamber.

15. An enclosure for multiple speakers having an interior, comprising:

a first body having six walls each having an interior surface defining said interior of said body, wherein one of said walls comprises an opening adapted to receive one of the speakers and the other of said surfaces defining four corners opposite said front wall; and an element mounted entirely within one of said corners having an acoustically reflective surface facing said interior positioned in a plane that intersects and is inclined with respect to each of said interior surfaces of said walls that form said one corner.

16. The multiple driver speaker enclosure of claim 15 further comprising a tuned port opening within the surface opposite said speaker opening.

17. The multiple driver speaker enclosure of claim 15 wherein the first body is a bass chamber.

18. The multiple driver speaker enclosure of claim 15 further including a second body positioned above said first body and being a mid-high range chamber.

19. The multiple driver speaker enclosure of claim 18, wherein the mid-high range chamber includes six interior surfaces defining said interior of said mid-high range chamber, wherein one of said surfaces has a speaker opening and the other of said surfaces defines four corners opposite said speaker opening.

20. The multiple driver speaker enclosure of claim 19, further comprising an element having an acoustically reflective surface facing said interior of said mid-high range chamber and being positioned in a plane that intersects and is inclined with respect to each of said interior surfaces that form said corner.

21. The multiple driver speaker enclosure of claim 18 further including a tweeter positioned within said mid-high range chamber.

22. A method of eliminating standing waves in an audio speaker, the steps comprising:

providing a speaker enclosure body having an interior comprising multiple walls having interior surfaces, wherein one of said walls comprises a front wall having a speaker opening adapted to receive the speaker and the other of said walls defining four corners opposite said front wall; and selectively positioning an element having an acoustically reflective surface entirely within one of said corners within said interior such that said reflective surface is situated in a plane that intersects and is inclined with respect to each of said interior surfaces of said walls that form said one corner.

23. The method of claim 22 the steps further comprising positioning a tuned port opening within said surface opposite said speaker opening.

* * * * *